US005874830A

United States Patent [19]

Baker

[11] Patent Number: 5,874,830

[45] Date of Patent: Feb. 23, 1999

[54] ADAPTIVELY BAISED VOLTAGE REGULATOR AND OPERATING METHOD

[75] Inventor: R. Jacob Baker, Meridian, Id.

[73] Assignee: Micron Technology, Inc., Boise, Id.

[21] Appl. No.: 988,396

[22] Filed: Dec. 10, 1997

[51] Int. Cl.[6] ..... G05F 3/16

[52] U.S. Cl. ..... 323/316; 365/189.09

[58] Field of Search ..... 327/546, 535; 323/316; 365/189.09

[56] References Cited

U.S. PATENT DOCUMENTS

| | | | |
|---|---|---|---|
| 5,130,635 | 7/1992 | Kase | 323/280 |
| 5,519,656 | 5/1996 | Maccarrone et al. | 365/189.09 |
| 5,549,205 | 8/1996 | Monticelli | 323/274 |
| 5,596,534 | 1/1997 | Manning | 365/189.09 |
| 5,614,856 | 3/1997 | Wilson et al. | 327/170 |
| 5,663,919 | 9/1997 | Shirley et al. | 365/226 |

OTHER PUBLICATIONS

Micropower Techniques, Chapter 3, Eric A. Vittoz, "Design of Analog–Digital VLSi Circuits for Telecommunications and Signal Processing", 2nd Edition, Prentice Hall, Englewood Cliffs, NJ 07632, pp. 52–96.

R. Jacob Baker, et al., "CMOS Circuit Design, Layout, and Simulation", Part IV, Mixed–Signal Circuits, The Institute of Electrical and Electronics Engineers, Inc., New York, pp. 702–703, 1997.

*Primary Examiner*—Shawn Riley

*Attorney, Agent, or Firm*—Dickstein Shapiro Morin & Oshinsky LLP

[57] ABSTRACT

This invention relates to a voltage regulator particularly suitable for powering a submicron DRAM. The regulator relies on a feed forward approach in which current to a load is controlled by a differential amplifier which provides a control signal to a current regulating transistor based on the difference in a voltage sensed at the regulator output and a reference voltage. The control signal is also suppied to a current sensing circuit which provides a signal for adaptively biasing the tail current of the differential amplifier during peak current drain periods.

49 Claims, 2 Drawing Sheets

ADAPTIVELY BAISED VOLTAGE REGULATOR AND OPERATING METHOD

BACKGROUND OF THE INVENTION

1. Field of the Invention

The present invention relates to the field of voltage regulators and more specifically to a method and apparatus for the control of a voltage utilized by a load, such as a DRAM, during periods where the load current fluctuates considerably.

2. Description of Related Art

Voltage regulator circuits are known in which a voltage supply to a load is regulated by regulating the current supplied to the load. One such voltage regulator is illustrated in U.S. Pat. No. 5,548,205.

Typical of such prior art structures is the use of a feedback circuit for sensing the output voltage which is used for comparison with a reference voltage with the difference between the output and reference voltages being used to control the current supplied to a load. With such circuits, when there is a considerable change in the current drawn by the load, the voltage regulator circuit also senses the large current drain and, compensates for it through the use of the negative feedback current sensing circuit to increase the current supplied to the load and thereby maintain the output voltage at a relatively constant level. Although such voltage regulators generally perform an adequate job of voltage regulation, a considerable amount of power and thus heat is drawn because of the use of the negative feedback circuit. In addition, the negative feedback circuit decreases the response time to sharp current fluctuations and also takes up considerable layout area when the voltage regulator is incorporated in an integrated circuit (IC) structure.

An adaptive voltage follower is also known which could be used as a voltage regulator and is shown in the text CMOS Circuit Design, Layout, and Simulation by Baker, R. J. et al at Chapter 26, FIG. 26.25, page 703. This circuit uses a differential amplifier to control an output voltage to a load based on changes to an inut voltage. The differential amplifier compares the output and input voltages and based on variations between the two generates a control signal which is used to control an output current control transistor to thereby control the output voltage. A feed forward current sensor formed by serially connected complementary transistors also receives the control signal and develops another control signal which partially controls the tail current to the differential amplifier. In this feed forward current sensing design, a current source is also required to ensure that an adequate tail current is always supplied to the differential amplifier. Although this curcuit could be adapted for use as a voltage regulator, and avoids the delay problem with a feedback current sensing approach, the differential amplifier used is unbalanced and a separate tail current source is required, making the circuit less accurate and more complex than desired. In addition, the output voltage is directly supplied to one input of the differential amplifier, so that output voltage connot be controlled to within desired limits, less than the limits of the supply voltage.

Additional problems also occur when a voltage regulator is used to regulate the supply voltage to a DRAM. In a DRAM an external voltage must be lowered and regulated during periods of considerable voltage and current fluctuation, for example, a DRAM load current may quickly fluctuate between microamps and milliamps during use. In order to accomodate such large current fluctuations a DRAM power suppy may use two separate power amplifiers for supplying operative power to the DRAM memory array, one of them a low power amplifier used to supply steady state current on the order of microamps, and another higher power amplifier for supplying transitory higher currents when needed on the order of milliamps. Typically the lower power amplifier supplies current during times of low current drain, while the higher power amplifier is switched on and operative only when needed during times of high current comsumption.

In addition, the higher power amplifier may in fact be constructed as a bank of lower power amplifiers, for example ten power amplifiers may be actually used, which are switched on in sequence as the required current to the load increases. That is, as more current is required additional amplifiers are turned on to meet the power demand. The control of multiamplifier power regulator circuits is complex requiring a control circuit for developing the necessary control signals for turning the various power amplifiers on and off on a dynamic basis in accordance with the required DRAM load current.

In addition, such multiamplifier voltage regulators tend to occupy considerable layout area when formed in an integrated circuit structure.

SUMMARY OF THE INVENTION

The present invention is designed to overcome problems associated with the response time of conventional current sensing negative feedback voltage regulators. The present invention also avoids problems associated with the use of complex multiamplifier regulated power supply designs with their attendant complex circuitry and large layout areas.

Thus, one object of the invention is the provision of a voltage regulator for supplying a regulated voltage within desired limits which dissipates low power while providing responsive voltage regulation even under conditions of large scale voltage and current fluctuations which might occur, for example, during dynamic operation of a DRAM or other integrated circuit structures.

An additional object of the invention is the provision of a voltage regulator which has low static power consumption, reduces the response time of the circuit to load fluctuations, does not require a separate current source, and which has a small layout area for circuit architecture on a chip.

An additional object of the invention is the provision of an integrated circuit memory device, for example a DRAM or SRAM, having a built-in voltage regulator which dispenses with the multiamplifier design, but which is still able to responsively accomodate a wide range of voltage and current fluctuations of the load.

An additional object of the invention is the provision of a voltage regulator design which has a simple structure and which is easy to integrate.

An additional object of the invention is the provision of a voltage regulator which can better accomodate wide swings in output voltage fluctuation.

The foregoing and other objects, advantages, and features of the invention are achieved in a circuit configuration and method of operation for a voltage regulator in which a controlled element, such as a transistor, is used for regulating the current supplied to a load connectable to a load connection point of the regulator. The load connection point is also connected through a voltage divider to one input of a differential amplifier which receives at its other input a reference voltage. The output, taken from one leg of the differential amplifier, is coupled to control the transistor controlling the load current. The output of the differential amplifier is also supplied to a current sensing circuit formed by a pair of serially connected complimentary transistors which supply, as an output signal, a signal representing the current supplied to the load connection point based on the output from the differential amplifier. The output of the current sensing transistor pair is also applied as an input to control the tail current, i.e., bias, of the differential amplifier.

The circuitry as described provides an adaptive bias technique where a load current is sensed, not by feedback, but by a forward control current, and a signal representing the load current is then used to automatically adjust the internal bias current of the differential amplifier without needing an additional current source. A simple, low cost regulator is provided which can handle wide fluctuations in output voltage and current and which can also allow for regulation of the voltage within a desired range up to the full value of the supply voltage which is available for regulation.

The foregoing objects, features and advantages of the invention will become more apparent from the following detailed description of the invention which is provided in connection with the attached drawings in which like parts or elements throughout the figures are denoted by like reference numerals.

DETAILED DESCRIPTION OF THE INVENTION

Figure 1:
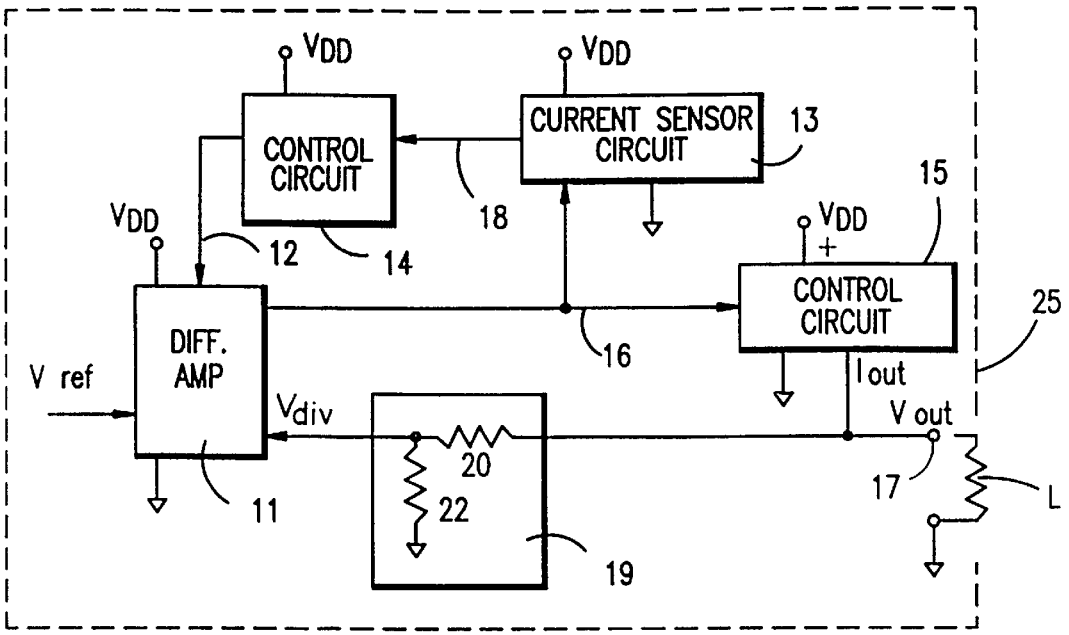
FIG. 1 is a block diagram of a voltage regulator constructed and operated in accordance with the teachings of the invention.

FIG. 1 illustrates in block diagram form the voltage regulator 25 of the invention. A load L is connectable across an output connection formed of a terminal 17 and ground. Current to the load is supplied through a control circuit 15 under control of an output signal 16 of differential amplifier 11. The output control signal 16 is also applied as an input to a current sensor circuit 13 which in turn supplies a sensed current signal 18 back to a second control circuit 14 which regulates the bias current, also called tail current, of the differential amplifier 11. A resistor voltage divider network 19 is interconnected between the output terminal 17 and one input of the differential amplifier 11. A reference voltage Vref is supplied to another input of the differential amplifier 11.

During operation, a change in the current drawn by the load L will result in a change in the voltage at terminal 17 and at the junction of the resistors 20, 22 of the voltage divider network 19. This, in turn, will be reflected at the voltage divider output Vdiv, which is input to the differential amplifier where it is compared to the voltage of the Vref input to the differential amplifier. An imbalance in the voltages input to the differential amplifier 11 will be reflected in the control signal 16 which is applied t o the control circuit 15 and current sensor circuit 13.

The control circuit 15 in response to control signal 16 adjusts the output current Iout supplied to the load and to the voltage divider 19. The bias or tail current of the differential amplifier is further controlled by the output signal 18 of the current sensor circuit 13. The control signal 18 operates control circuit 14 which controls the bias or tail current 12 to the differential amplifier 11. Consequently, since the current sensor circuit 13 operates in response to the forward control signal 16 supplied to the control circuit 15 which regulates load current, the amount of current which is supplied by the control circuit 15 is immediately sensed by circuit 13 and used as a control signal 18 to control the tail current, i.e., bias current, of differential amplifier 11. This improves the responsiveness of the voltage regulator circuit.

Moreover, unlike the circuit shown in the CMOS text noted above, this circuit does not require a separate tail current current source, thus simplifying circuit design and reducing its cost and size. In addition, as shown below in greater detail, in a preferred embodiment the two arms of the differential amplifier are balanced thereby providing a more accurate and responsive circuit. Finally, the use of the voltage divider 19 permits easy selection of the control range of the voltage regulator circuit within the limits of the supply voltage VDD.

During static or steady state operations the voltage regulator configuration illustrated in FIG. 1 will have a decreased power consumption compared with circuits which use a negative feedback technique. In addition, because the current control signal 16 is applied directly to current sensor circuit 13 the response time of the voltage regulator 25 is reduced. Moreover, since feedback circuits are not required, the voltage regulator 25 can be fabricated in an integrated circuit with a reduced layout area.

Figure 2:
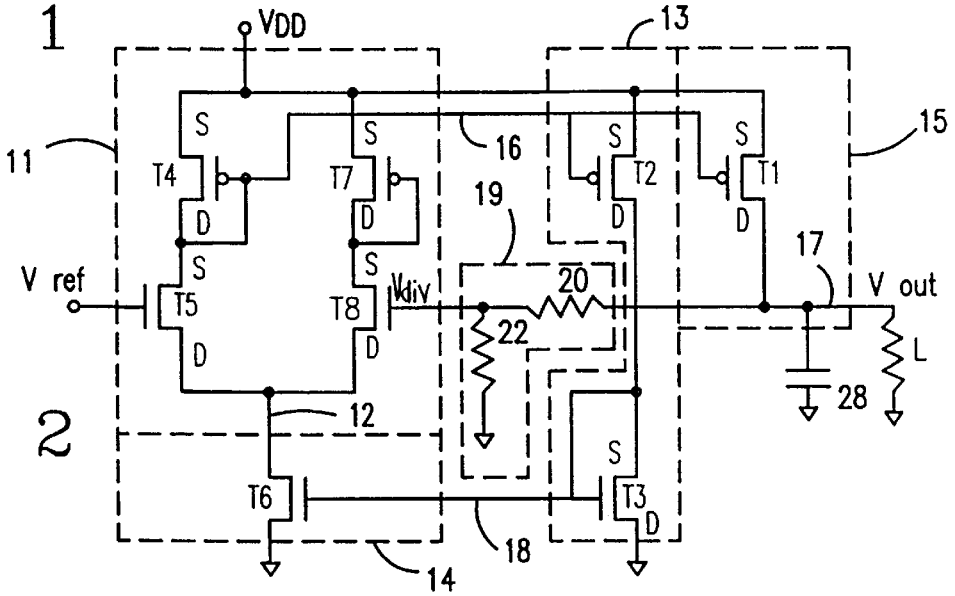
FIG. 2 is a detailed schematic drawing of a preferred embodiment of the voltage regulator illustrated in block diagram form in FIG. 1.

FIG. 2 illustrates in electrical schematic form a preferred voltage regulator circuit which can be used to carry out the invention.

The FIG. 2 circuit utilizes eight MOS FET transistors T1 . . . T8. Transistor T1 functions as the control circuit 15 while transistors T2 and T3 which are complementary form the current sensor circuit 13. The drain of transistor T2 is connected to the source of transistor T3. The source of transistor T2 is connected to the supply voltage VDD, and the drain of transistor T3 is connected to ground. The voltage divider 19 is formed by the interconnection of two resistors of 20 and 22. Resistor 22 has one of its ends connected to ground. One end of resistor 20 is connected to terminal 17. The differential amplifier is formed by transistors T4, T5, T7 and T8, with T6 forming the tail current control circuit 14. Complementary transistors T4 and T5 form one leg of the differential amplifier 11 while complementary transistors T7 and T8 form the other leg. The drains of transistors T4 and T7 are connected to the respective source of transistors T5 and T8. Each of the legs of the differential amplifier 11 is connected in common via the drains of transistors T5 and T8 to the source of transistor T6 which controls the tail current or bias current through the differential amplifier 11. Transistor T5 has its gate connected to receive the input reference voltage Vref while transistor T8 has its gate connected to receive as an input the output of the voltage divider 19. Although not necessary, a capacitor 28 is also illustrated as provided in parallel across the load L. Voltage is supplied from a supply terminal VDD to the sources of each of transistors T1, T2, T4 and T7 and the ground points are as shown in FIG. 2. As shown therein, transistors T3 and T6 have their drains connected to ground. Current to the load is controlled by transistor T1 which has its source connected to VDD and its drain connected to output terminal 17. The gates of transistors T4 and T7 are connected to their respective drains, while the gate of transistor T3 is connected to its source.

In operation, the output voltage Vout is provided through the voltage divider 19 to the gate of transistor T8 which controls the current flow through the differential amplifier leg formed by complementary transistors T7 and T8. Current through the leg formed by complementary transistors T4 and T5 is contacted by the voltage Vref which is connected to the gate of transistor T5. A tail or bias current through the differential amplifier is provided through transistor T6 which has its gate connected to the output of the current sensor circuit 13, being taken off the interconnection point of the transistors T2 and T3. Since each of the legs of the differential amplifier is formed of a pair of complementary transistors T4, T5 and T7, T8, the differential amplifier 11 is balanced.

The differential amplifier 11 provides an output control signal 16 from the interconnection of transistors T4 and T5 which is applied to the gate of transistor T2 as well as to the gate of transistor T1. The control signal 16 supplied to transistor T1 controls the current supplied to the load L, while the control signal 16 supplied to transistor T2 represents the current which is to be supplied to the load by the transistor T1. During normal or quiescent operations, normal voltage variations in the output at Vout will be handled by the differential amplifier 11 adjusting the currents in legs formed by transistors T4 and T5 and T7 and T8 in accordance with a total tail current being controlled by the transistor T6 and based on the imbalance in the voltages Vout (as reduced by the voltage divider) and Vref. Thus, any variation between the respective voltages applied to the gates of T8 and T5 will result in an imbalance of currents in the legs of the differential amplifier 11 and a corresponding raising or lowering of the output control signal 16 taken from the interconnection point of T4 and T5.

The tail current biassing of the differential amplifier is controlled by the transistor T6 which receives the control signal 18 from the interconnection point of T2 and T3.

As illustrated in FIG. 2, transistors T1, T2, T4 and T7 are P-channel type MOS transistors, whereas the transistors T5, T8, T3 and T6 are N-channel type MOS transistors.

It should be noted that although the circuit configuration of FIG. 1 is illustrated in FIG. 2 as being formed with MOS transistors, it can be constructed and work equivalently with other types of transistors, e.g. bipolar, as well. The voltage regulator circuit shown in FIG. 2 may be implemented as a stand alone integrated circuit, or as part of a larger integrated circuit which contains other circuit package powered by the voltage regulator, such as a DRAM or SRAM memory device.

Figure 3:
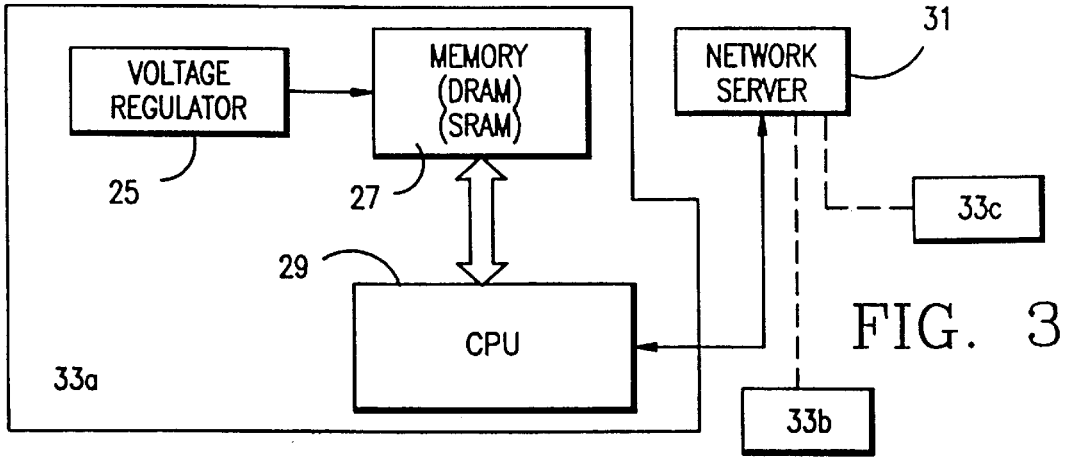
FIG. 3 illustrates the use of the voltage regulator to power a memory array such as a submicron DRAM or SRAM as well as illustrating the manner in which the memory array may be connected to a processor and to a larger computer network.

FIG. 3 illustrates in block diagram form the use of the voltage regulator circuit of FIGS. 1 and 2 to supply power to a memory device 27 such as a DRAM or SRAM as the load L. FIG. 3 also illustrates that the memory is connected to a CPU (central processing unit) 29 such as a microprocessor which in turn may also be part of a computer 33*a* connected to other computers 33*b*, 33*c*, etc. through network server 31. Processors such as a CPU 29 may store instructions and/or data in the memory device 27 to which voltage regulator 25 is connected. The CPU 29 may be part of any electronic system such as, but not limited to, the illustrated computer 33*a*, or a radio, pager, television, telephone, GPS receiver, other communications system, or a control system, or the like.

As shown in FIG. 3, the CPU 29, may also be connected into a computer or other communications network through a network server 31. FIG. 3 also illustrates one such CPU 29 system 33*a* including the voltage regulator 25 memory device 27 and CPU 29. Additional similar CPU based systems are shown as elements 33*b* and 33*c*.

Figure 4:
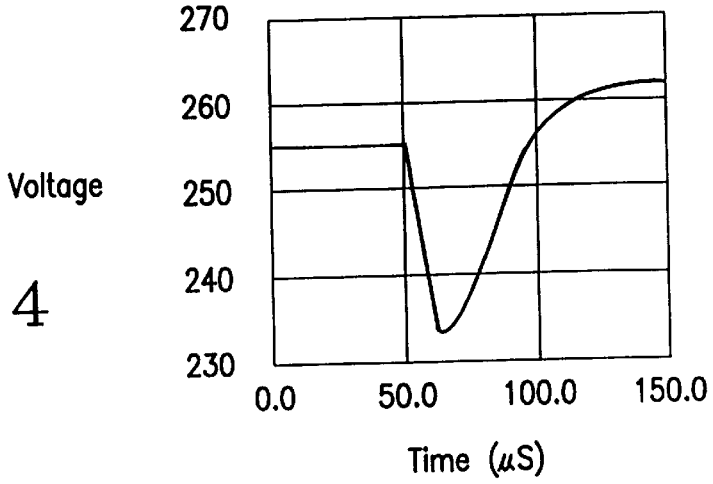
FIG. 4 illustrates the output of the voltage regulator of FIG. 2 when the load draws a current spike of 100 milliamps for a period of 10 nanoseconds.
Figure 5:
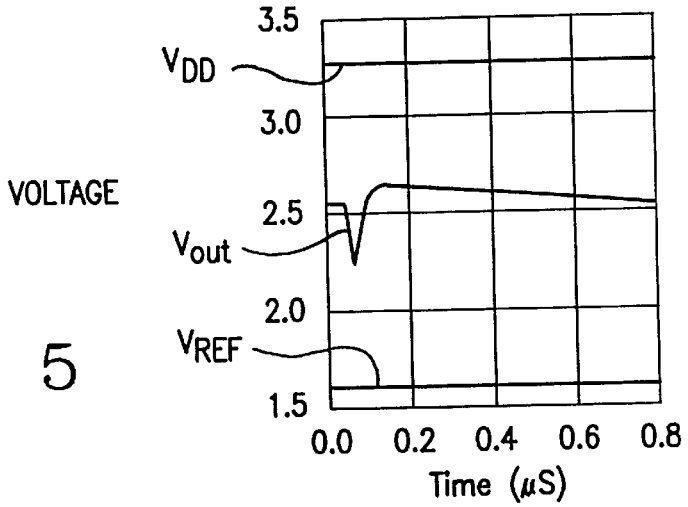
FIG. 5 illustrates the internal regulated voltage provided by the differential amplifier when the load draws a current spike of 100 milliamps for a period of 10 nanoseconds; and, FIG. 6 illustrates the current which is supplied by the voltage regulator to the load when a current spike of 100 milliamps for a period of 10 nanoseconds occurs.
Figure 6:
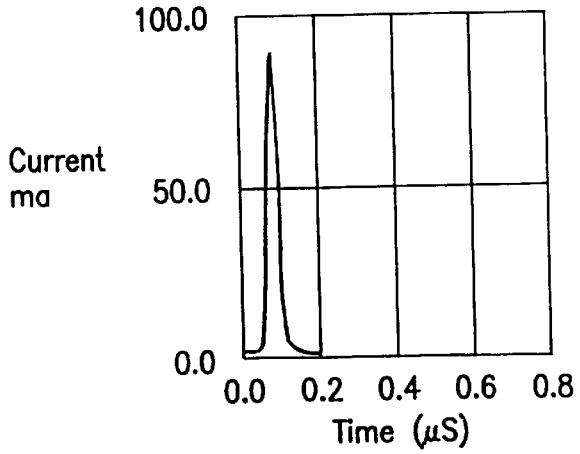

The manner in which the circuit illustrated in FIGS. 1 and 2 operates in the presence of a large change in load current is best illustrated by FIGS. 4, 5 and 6.

FIG. 4 illustrates the output of the FIG. 2 voltage regulator when the load consumes a current spike of about 100 milliamps starting at a location of 15 nanoseconds and lasts for a period of 10 nanoseconds.

FIG. 5 shows the internal regulated voltage of the voltage regulator when such a 100 milliamp spike occurs. As shown, both the supply voltage VDD and the reference voltage Vref remains relatively steady, whereas the internal regulated voltage varies in response to the 100 milliamp spike.

FIG. 6 shows the current supplied by the voltage regulator in response to the load variations which cause the current spike illustrated in FIG. 4. As shown, at the position where the current spikes occur, additional current is supplied by the regulator to the load to thereby maintain the output voltage and current at a substantially constant value, as depicted in FIG. 5.

It should be noted that the FIG. 2 preferred circuit of the invention is illustrated with reference to specific MOS transistors. However, it should also be understood that wherever a P-channel MOS is shown an N-channel MOS can be substituted and vice versa with the appropriate adjustments in VDD voltage level, as well known in the art.

As is apparent from the foregoing, a new and improved method and circuit have been provided for the control of the output voltage of a voltage regulator which has particular utility when supplying voltage to a circuit such as a DRAM or SRAM memory device.

While certain preferred embodiments of the invention have been described and illustrated, it should be apparent to those skilled in the art that certain changes and/or modifications can be made without departing from the spirit and scope of the invention, which is defined solely by the scope of the following claims.

I claim:

1. A voltage regulator comprising:

a first output connection;

a circuit which provides a first control signal representing a load current at said first output connection;

a voltage divider for dividing a voltage appearing at said first output connection;

a first input connection for receiving a reference voltage;

a differential amplifier having a first input coupled to said output connection, through said voltage divider, for receiving a voltage representing a voltage at said first output connection, and a second input coupled to said first input connection, for receiving a voltage representing a voltage at said first input connection, said differential amplifier providing a second control signal in response to the signals supplied to said first and second inputs;

a control circuit for controlling a bias current to said differential amplifier in response to said first control signal, said control circuit containing no current source; and a controlled circuit for controlling the load current supplied to said output connection in response to said second control signal.

2. A voltage regulator as in claim 1 wherein said controlled circuit includes a controlled solid state device.

3. A voltage regulator as in claim 2 wherein said controlled solid state device is a MOS transistor.

4. A voltage regulator as in claim 3 wherein said MOS transistor has one of its source and drain connected to a first voltage reference point and the other of its source and drain connected to said output connection, and its gate coupled to receive said second control signal.

5. A voltage regulator as in claim 1 wherein said circuit for providing said first control signal comprises:

a serial connection of a first MOS transistor and a second MOS transistor, one of a source and drain of said first MOS transistor being connected to a first voltage reference point and the other of the source and drain of the first MOS transistor being connected to one of the source and drain of the second MOS transistor, the other of the source and drain of the second MOS transistor being connected to a second voltage reference point, the interconnection of the first and second MOS transistors providing said first control signal, the gate of said first MOS transistor receiving said second control signal.

6. A voltage regulator as in claim 5 wherein one MOS transistor is a P-channel transistor and the other MOS transistor is an N-channel transistor.

7. A voltage regulator as in claim 1 wherein said differential amplifier comprises:

a first MOS transistor having its gate coupled through said voltage divider to said first output connection, and one of its source and drain coupled to one of a source and drain of a second MOS transistor, the other of the source and drain of the second MOS transistor being connected to a first voltage reference point, a third MOS transistor having its gate coupled to said first input connection and one of its source and drain coupled to the source and drain of a fourth MOS transistor, the other of the source and drain of the fourth MOS transistor being connected to said first voltage reference point, the other of the source and drain of said first and third MOS transistors being commonly connected and coupled to a second voltage reference point.

8. A voltage regulator as in claim 7 wherein said second control signal is produced at the interconnection of said third and fourth MOS transistors.

9. A voltage regulator as in claim 5 wherein the interconnection of said first and second MOS transistors is coupled to the gate of said second MOS transistor.

10. A voltage regulator as in claim 7 wherein the interconnection of said third and fourth MOS transistors is coupled to the gate of said fourth MOS transistor.

11. A voltage regulated memory device comprising:

a first connection;

a circuit which provides a first control signal representing a load current at said first connection;

a second connection for receiving a reference voltage;

a differential amplifier having a first input coupled to said first connection and a second input coupled to said second connection, said differential amplifier providing a second control signal in response to the signals supplied to said first and second inputs;

a control circuit for controlling a bias current to said differential amplifier in response to said first control signal; and a controlled circuit for controlling the current supplied to said first connection in response to said second control signal; and, a memory circuit connected to said first connection and receiving operative power therefrom.

12. A memory device as in claim 11 wherein said memory circuit is a DRAM memory circuit.

13. A memory device as in claim 11 wherein said memory circuit is a SRAM memory circuit.

14. A memory device as in claim 11 further comprising a voltage divider connected between said first connection and said first input of said differential amplifier.

15. A memory device as is claim 11 wherein said control circuit for controlling the bias current of said differential amplifier contains no current source.

16. A processing system comprising:

a processing device which processes data; and a memory device coupled to and operative in conjunction with said processing device, said memory device comprising:

a first connection;

a circuit which provides a first control signal representing a load current at said first connection;

a second connection for receiving a reference voltage;

a differential amplifier having a first input coupled to said first connection and a second input coupled to said second connection, said differential amplifier providing a second control signal in response to the signals supplied to said first and second inputs;

a control circuit for controlling a bias current to said differential amplifier in response to said first control signal; and, a controlled circuit for controlling the current supplied to said first connection in response to said second control signal; and, a memory circuit connected to said connection and receiving operative power therefrom.

17. A processing system as in claim 16 further comprising a voltage divider connected between said first connection and said first input of said differential amplifier.

18. A processing system as in claim 16 wherein said control circuit for controlling the bias current of said differential amplifier contains no current source.

19. A processing system as in claim 16 wherein said processing device and memory device form part of a computer.

20. A processing system as in claim 16 wherein said processing device and memory device form part of a radio.

21. A processing system as in claim 16 wherein said processing device and memory device form part of a GPS receiver.

22. A processing system as in claim 16 wherein said processing device and memory device form part of a telephone.

23. A processing system as in claim 16 wherein said processing device and memory device form part of a television.

24. A processing system as in claim 16 wherein said processing device and memory device form part of a control system.

25. A processing system as in claim 16 wherein said processing device and memory device form part of a communicating system.

26. A processing network comprising:

at least two interconnectable processing systems which process data and which are capable of communicating with each other over a communications network; at least one of said processing systems including a processing device having a memory device coupled therewith, said memory device comprising:

a first connection;

a circuit which provides a first control signal representing a load current at said first connection;

a second connection for receiving a reference voltage;

a differential amplifier having a first input coupled to said first connection and a second input coupled to said second connection, said differential amplifier providing a second control signal in response to the signals supplied to said first and second inputs;

a control circuit for controlling a bias current to said differential amplifier in response to said first control signal; and, a controlled circuit for controlling the current supplied to said first connection in response to said second control signal; and a memory circuit connected to said first connection and receiving operative power therefrom.

27. A processing system as in claim 26 further comprising a voltage divider connected between said first connection and said first input of said differential amplifier.

28. A processing system as in claim 26 wherein said control circuit for controlling the bias current of said differential amplifier contains no current source.

29. A processing system as in claim 26 wherein said processing device and memory device form part of a computer.

30. A processing system as in claim 26 wherein said processing device and memory device form part of a radio.

31. A processing system as in claim 26 wherein said processing device and memory device form part of a GPS receiver.

32. A processing system as in claim 26 wherein said processing device and memory device form part of a telephone.

33. A processing system as in claim 26 wherein said processing device and memory device form part of a television.

34. A processing system as in claim 26 wherein said processing device and memory device form part of a control system.

35. A processing system as in claim 26 wherein said processing device and memory device form part of a communicating system.

36. A voltage regulator circuit comprising:

an output connection;

a first voltage supply point;

a reference voltage connection for receiving a reference voltage;

a second voltage supply point;

a first MOS transistor having one of its source and drain connected to said output connection and the other of its source and drain connected to said first supply voltage point, said first MOS transistor controlling the current supplied to said output connection in response to a second control signal applied to its gate;

a series connection of a second and a third MOS transistor, one of the source and drain of the second MOS transistor being connected to one of the source and drain of the third MOS transistor to form an interconnection of the second and third MOS transistor, the other of the source and drain of the second MOS transistor being connected to said first supply voltage point, the other of the source and drain of the third MOS transistor being connected to said second supply voltage point, the interconnection of the second MOS transistor and third MOS transistor being connected to a gate of the third MOS transistor and supplying a first control signal, a gate of said second MOS transistor being operative in response to said second control signal;

a differential amplifier formed by a fourth, fifth, seventh and eighth MOS transistors, one of the source and drain of the fourth MOS transistor being connected to said first supply voltage point, the other of said source and drain of the fourth MOS transistor being connected to one of the source and drain of the fifth MOS transistor to form an interconnection of the fourth and fifth MOS transistors, a gate of said fourth MOS transistor being connected to the interconnection of the fourth and fifth MOS transistors and supplying said second control signal, a gate of the fifth MOS transistor being connected to said reference voltage connection, one of the source and drain of the seventh MOS transistor being connected to the first supply voltage point, the other of the source and drain of the seventh MOS transistor being connected to one of the source and drain of the eighth MOS transistor to form an interconnection of the seventh and eighth MOS transistors, the other of the source and drain of the eighth MOS transistor being connected to the other of the source and drain of the fifth MOS transistor, the interconnection of the seventh and eighth MOS transistors being connected to a gate of the seventh MOS transistor, a gate of said eighth MOS transistor being connected to said output connection through a voltage dividing circuit, the voltage dividing circuit also being connected to said second voltage supply point;

a sixth MOS transistor having one of its source and drain connected to the common connection of the other of the source and drain of said fifth and eighth MOS transistors, the other of the source and drain of said sixth transistor being connected to said second voltage supply point, the gate of said sixth MOS transistor being connected to receive said first control signal.

37. A voltage regulator as in claim 36, further comprising:

a capacitor connected between said output connection and said second voltage supply point.

38. A voltage regulator as in claim 36 wherein said first, second, fourth and seventh MOS transistors are one of a P-channel and N-channel type and said third, fifth, sixth, and eighth MOS transistors are the other of said P-channel and N-channel type.

39. A voltage regulator as in claim 38 wherein said first, second, fourth and seventh MOS transistors are P-channel type and said third, fifth, sixth and eighth MOS transistors are N-channel type.

40. A method of regulating voltage comprising the steps of:

sensing a load current;

sensing a load voltage;

voltage dividing said load voltage;

sensing a reference voltage;

comparing the sensed reference voltage with the divided load voltage in a differential amplifier to provide an output control signal representing the difference between the sensed divided load voltage and reference voltage;

controlling a tail current of said differential amplifier with said sensed load current; and regulating the supply of current to said load with said output control signal.

41. A method as in claim 40, wherein the control of said tail current is performed without requiring a current source.

42. A method as in claim 40 wherein said load comprises a memory device.

43. A method as in claim 40 wherein said load current is sensed by sensing the level of said output control signal.

44. A method as in claim 43 wherein said step of sensing load current comprises the steps of:

using a pair of serially connected complementary transistors connected between a supply voltage and ground, and obtaining a sensed load current from the interconnection of said transistors, one of said transistors being controlled by said output control signal.

45. A method as in claim 42 wherein said method further comprises the step of:

operating said memory device with a processor.

46. A method as in claim 43 further comprising the steps of:

using complementary series connected transistors in each leg of said differential amplifier, each of said legs being commonly connected to a transistor for controlling tail current of said differential amplifier, said sensed current signal being used to control said tail current control transistor.

47. A method as in claim 46 further comprising the step of using the series connection of transistors in one leg of said differential amplifier to supply said output control signal.

48. A method as in claim 46 wherein said tail current is solely controlled by said sensed load current.

49. A method as in claim 46 further comprising the step of supplying a capacitor across said load.

* * * * *

UNITED STATES PATENT AND TRADEMARK OFFICE

CERTIFICATE OF CORRECTION

PATENT NO. : 5,874,830

DATED : Feb. 23, 1999

INVENTOR(S) : R. Jacob Baker

It is certified that error appears in the above-identified patent and that said Letters Patent is hereby corrected as shown below:

On the title page, Item [54],

The title should read --VOLTAGE REGULATOR HAVING AN ADAPTIVELY BIASED CONTROL CIRCUIT--.

Signed and Sealed this

Fifteenth Day of June, 1999

*Attest:*

*Attesting Officer*

Q. TODD DICKINSON

*Acting Commissioner of Patents and Trademarks*